US007909176B2

(12) United States Patent
Merino

(10) Patent No.: US 7,909,176 B2
(45) Date of Patent: Mar. 22, 2011

(54) DRINKING STRAW INCLUDING AN ICE TRAPPING NET

(76) Inventor: Jaime A. Merino, La Mesa, CA (US)

( * ) Notice: Subject to any disclaimer, the term of this patent is extended or adjusted under 35 U.S.C. 154(b) by 0 days.

(21) Appl. No.: 10/219,583

(22) Filed: Dec. 24, 2002

(65) Prior Publication Data

US 2004/0118769 A1 Jun. 24, 2004

(51) Int. Cl.
*B01D 35/02* (2006.01)
*A47G 21/18* (2006.01)

(52) U.S. Cl. ..... 210/459; 210/467; 239/33

(58) Field of Classification Search ..... 210/459–461, 210/497.3, 499, 538, 175, 292, 464, 467; 239/33; 220/705, 709; 215/388
See application file for complete search history.

(56) References Cited

U.S. PATENT DOCUMENTS 1,847,879 A * 3/1932 Knecht ..... 239/33
4,938,375 A * 7/1990 Fantacone ..... 220/709
5,547,103 A * 8/1996 Murphy et al. ..... 220/709

* cited by examiner

*Primary Examiner* — Matthew O. Savage
(74) *Attorney, Agent, or Firm* — Eric Hanscou; Todd J. Langford

(57) ABSTRACT

The invention includes a drinking straw with an inverted funnel-shaped net retained near a lower end of the straw. The net traps ice at the lower end of the straw to cool liquid drawn into the lower end of the straw.

1 Claim, 4 Drawing Sheets

DRINKING STRAW INCLUDING AN ICE TRAPPING NET

(B) CROSS-REFERENCES TO RELATED APPLICATIONS

Not Applicable.

(C) STATEMENT REGARDING FEDERALLY SPONSORED RESEARCH OR DEVELOPMENT

Not Applicable.

(D) REFERENCE TO A "SEQUENTIAL LISTING", A Table, Or A Computer Program Listing APPENDIX SUBMITTED ON A COMPACT DISC (See 37 CFR 1.52(e) (5).

Not Applicable.

(E) BACKGROUND OF THE INVENTION

Not Applicable.

(1) Field of the Invention:

Not Applicable.

(2) Description of the Related Art including Information Disclosed under 37 CFR 1.97 and 1.98:

Not Applicable.

(F) BRIEF SUMMARY OF THE INVENTION

The invention includes a drinking straw with an inverted funnel-shaped net retained near a lower end of the straw. The net traps ice at the lower end of the straw to cool liquid drawn into the lower end of the straw.

(G) BRIEF DESCRIPTION OF THE SEVERAL VIEWS OF THE DRAWINGS

(H) DETAILED DESCRIPTION OF THE INVENTION

The drinking straw and ice trapping net are assembled as follows:

Step 1: obtain a plain straw (A), that would be at common convenient store;

Step 2: stretch a snug rubber washer (B), around the straw, and then slide the snug rubber washer (B), approximately two inches from the bottom of the straw;

Step 3: take a plastic net (C), and allow the top end of the straw (A), to pass through the middle of it until the snug rubber washer (B), stops it at the lower end of the straw;

Step 4: place the snug rubber washer (D), around the top end of the straw (A), like step three, except slide it down the straw (A), until it is about an inch above the plastic net;

Step 5: puncture the drink lid (E), through the bottom with the top end of the straw (A), then take the entire assembly with the lid (E), and place it in the soda drink cup and watch it capture the ice and bring with the ice with the lower end of the straw to the bottom of the cup.

Figure 1:
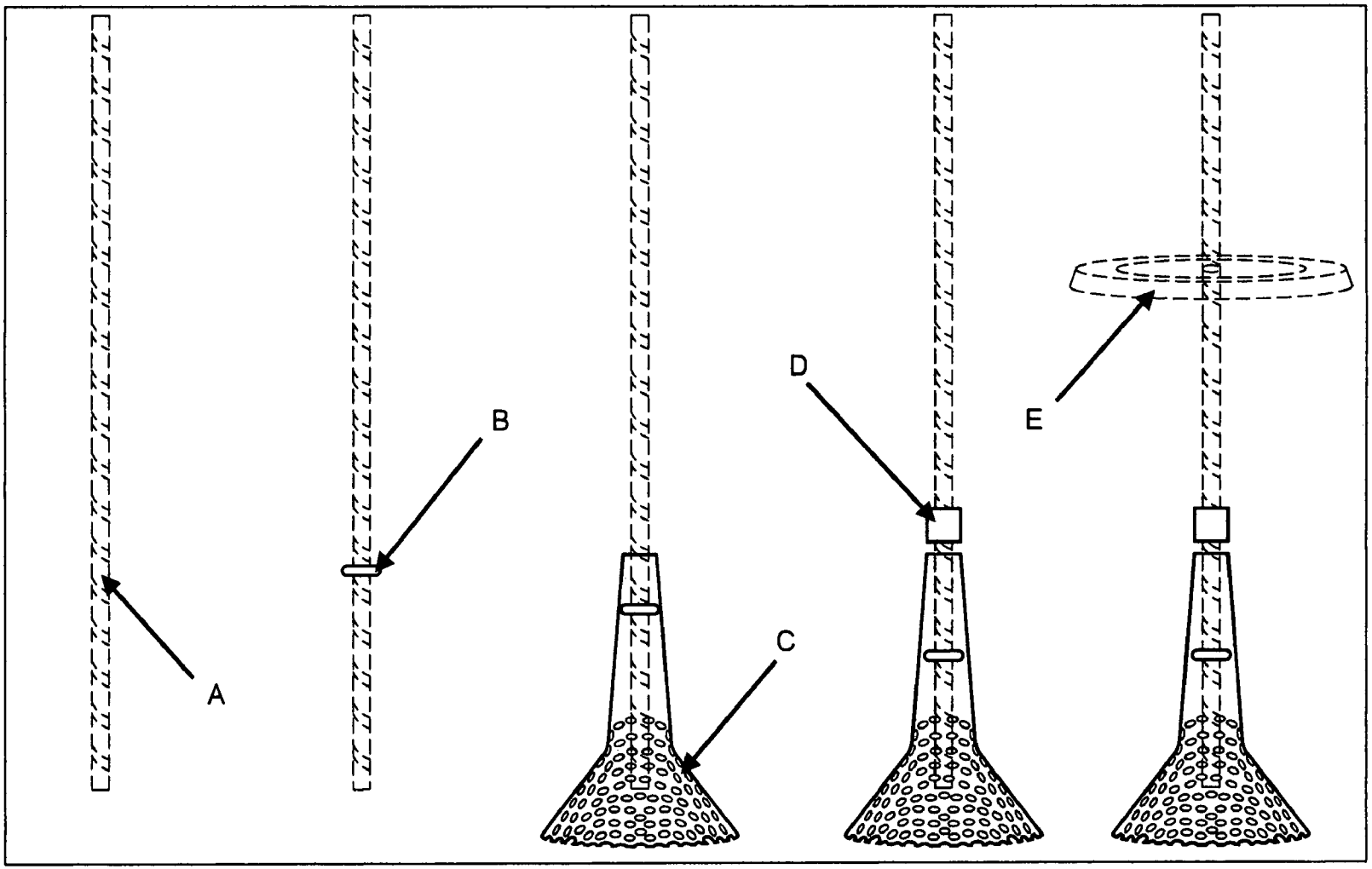
FIG. 1 shows the 5 steps necessary to put the drinking straw and ice trapping net assembly together.
Figure 2:
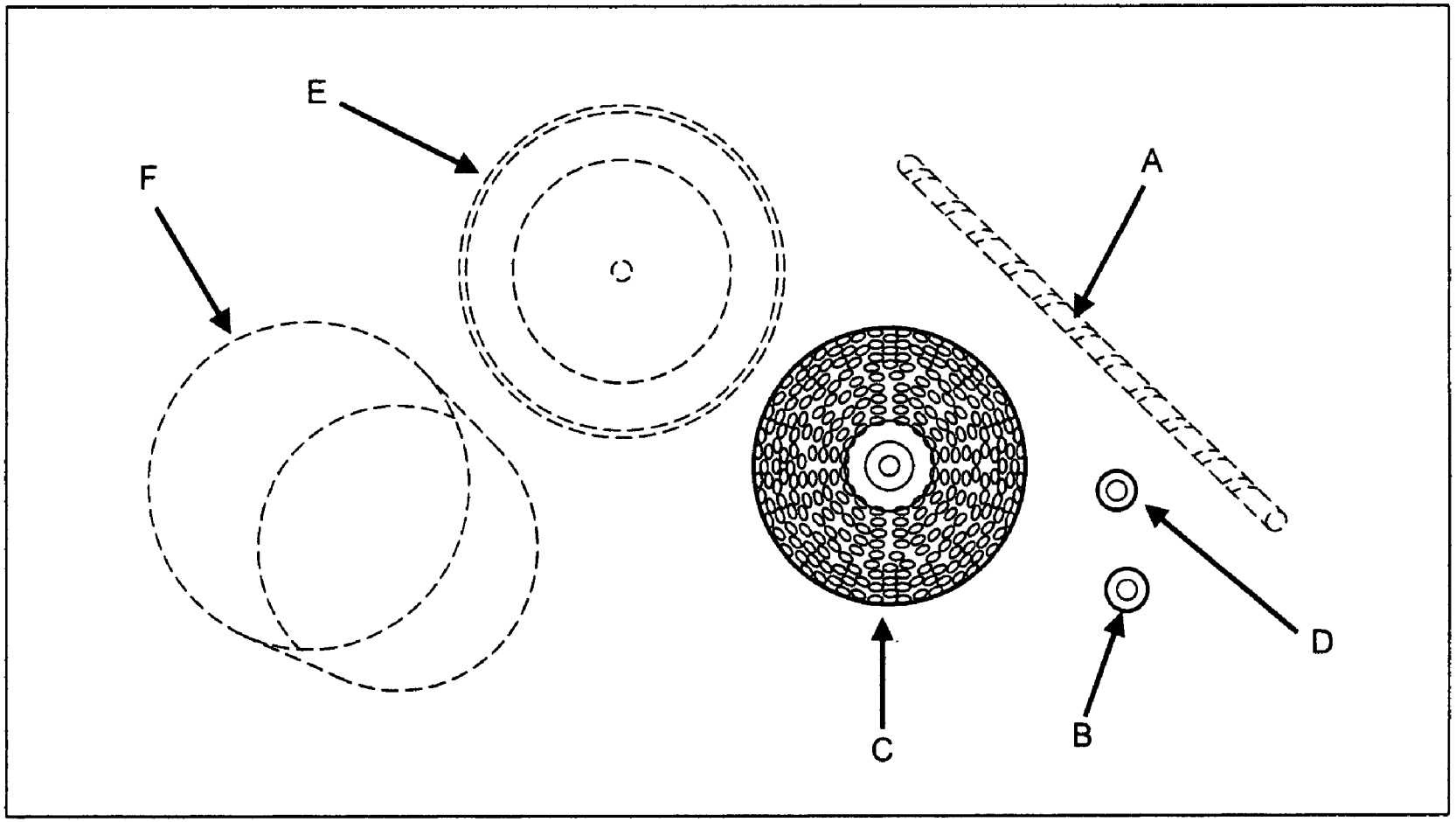
FIG. 2 shows the top view of the straw (A), the bottom snug rubber washer (B), the plastic net (C), the top snug rubber washer (D), the drink lid (E), and soft-drink cup (F)
Figure 3:
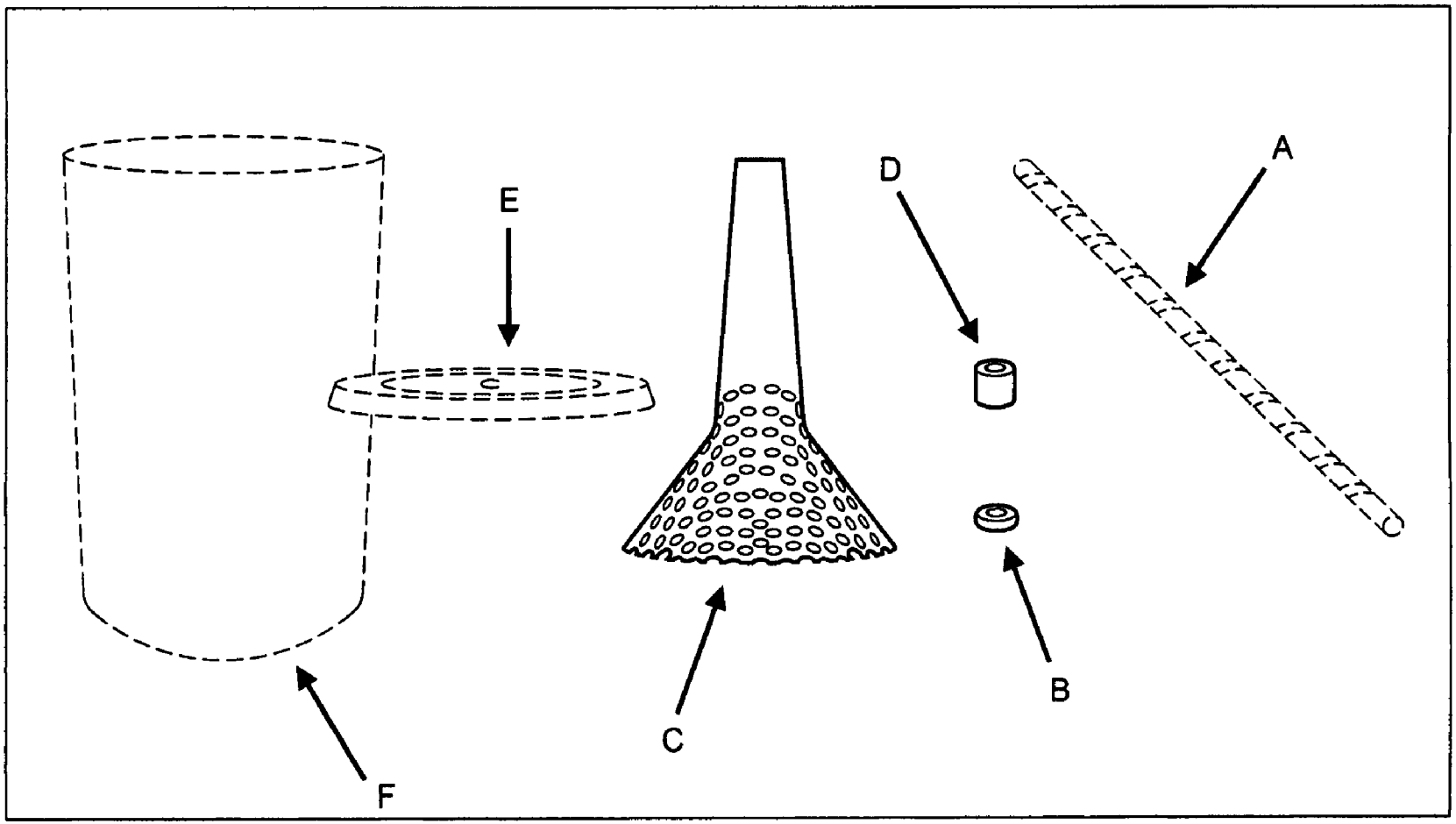
FIG. 3 shows the side view of the straw (A), the bottom snug rubber washer (B), the plastic net (C), the top snug rubber washer (D), the drink lid (E), and soft-drink cup (E)
Figures 3, 4:
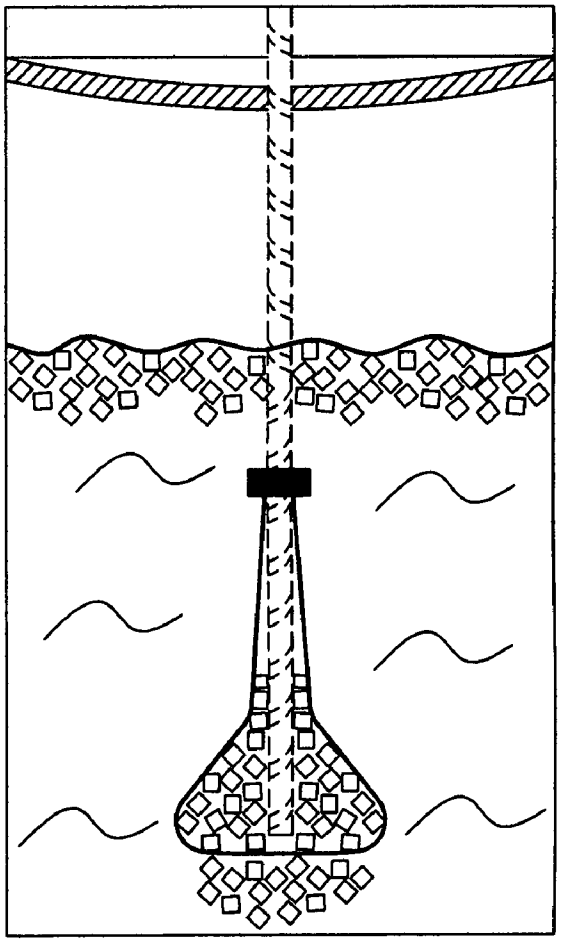
FIG. 4 shows the process in which the ICE-TRAP traps the ice and a KEY to help the viewer identify the different parts of the invention.
Figures 2, 4:
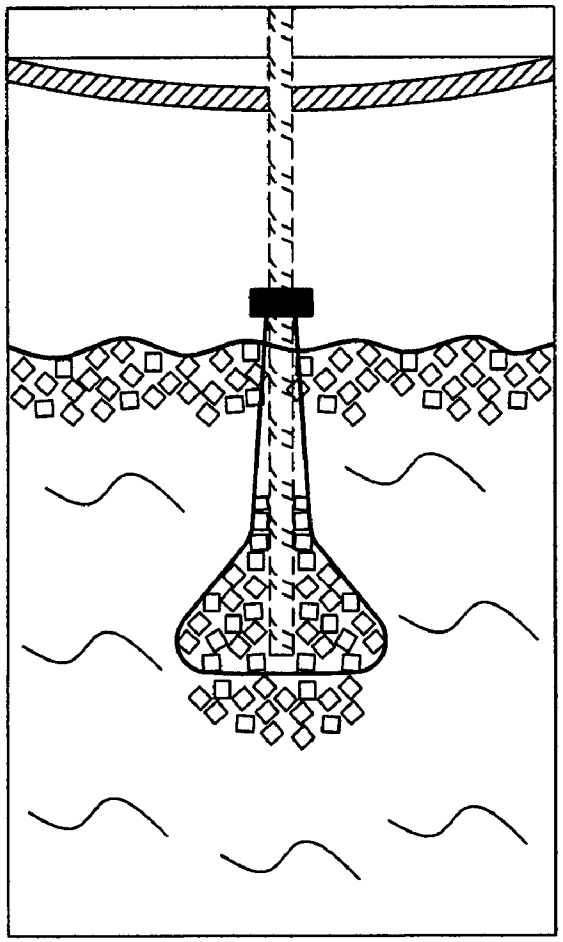
Figures 1, 4:
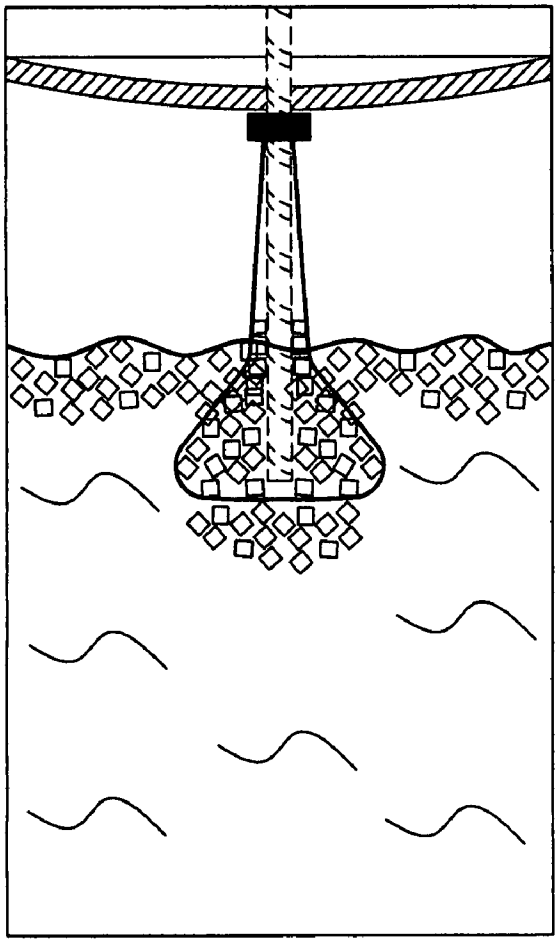

FIG. 4 shows the initial plunge of the assembly into the fluid and ice, immediately trapping ice as the straw makes it decent to the bottom of the cup. FIG. 4 also shows the ice trapped in the plastic net while the rest of the ice floats on the top distant from the end of the straw. Finally, FIG. 4 shows the assembly resting at the bottom of the drink insulated by the cold ice trapped around the lower end of the straw.

The invention claimed is:

1. A drinking apparatus comprising:

a straw having an upper end and a lower end;

a funnel shaped screen surrounding the lower end of said straw, wherein the screen has an upper end defining an upper opening and a lower end defining a lower opening, the upper opening surrounding an outer peripheral surface of the straw and having an inner diameter that is substantially smaller that an inner diameter of the lower opening, wherein said lower opening is positioned below the lower end of the straw, and wherein the inner peripheral surface of the screen defines a space for collecting ice to surround the lower end of said straw;

an upper washer frictionally engaging the outer peripheral surface of the straw and positioned between the upper end of the straw and the upper end of the screen, wherein the washer has an outer diameter larger that the inner diameter of the upper opening of the screen for engaging the upper end of said screen to prevent upward movement of the screen on said straw; and a lower washer frictionally engaging the outer peripheral surface of the straw and positioned between the lower end of the straw and the upper end of said screen, wherein the washer has an outer diameter that is larger that the inner diameter of the upper opening of the screen for engaging an upper interior portion of said screen to prevent downward movement of the screen on said straw.

* * * * *